US005156096A

United States Patent [19]

Lamprey

[11] Patent Number: 5,156,096

[45] Date of Patent: Oct. 20, 1992

[54] ANTI-ROTATIONAL OUTDOOR SHELF

[76] Inventor: John P. Lamprey, 5629 W. County Rd. 52 East, Bellvue, Colo. 80512

[21] Appl. No.: 670,532

[22] Filed: Mar. 15, 1991

Related U.S. Application Data

[63] Continuation-in-part of Ser. No. 420,366, Oct. 12, 1989, abandoned.

[51] Int. Cl.[5] ..... A47C 9/10

[52] U.S. Cl. ..... 108/152; 182/187; 108/108

[58] Field of Search ..... 108/152, 108; 248/218.4, 219.1, 231; 182/187, 92

[56] References Cited

U.S. PATENT DOCUMENTS

| | | | |
|---|---|---|---|
| 3,163,132 | 12/1969 | Nelson | 108/152 |
| 3,368,725 | 4/1967 | Martin | 224/9 |
| 3,392,802 | 7/1968 | Moore | 182/187 |
| 3,767,011 | 10/1973 | Witt | 182/187 |
| 4,124,094 | 11/1978 | Cande | 182/187 |
| 4,409,907 | 10/1983 | Norton | 108/152 |
| 4,600,081 | 7/1986 | Wade | 182/187 |
| 4,601,364 | 7/1986 | York | 182/187 |
| 4,625,833 | 12/1986 | Lewis | 182/187 |
| 4,776,503 | 10/1988 | Sink | 224/153 |
| 4,784,239 | 11/1988 | Kirkman | 182/187 |
| 4,830,143 | 5/1989 | Fisher | 108/152 X |
| 4,871,136 | 11/1989 | Bessinger et al. | 108/152 X |
| 4,928,793 | 5/1990 | Westimayer et al. | 182/187 |

OTHER PUBLICATIONS

Cabela's Catalog, "Master Hunter Tree Stand", 1984, p. 100.

Cabela's Catalog, "Portable Compact Tree Seat", 1984, p. 100.

Cabela's Catalog, "Qwik-Rest Hunting Tree Seat", 1984, p. 100.

Cabela's Catalog, "Lightweight Climbing Tree Stand", 1984, p. 100.

Cabela's Catalog, "TSS Tree Stand, Seat, and Safety Harness", 1984, p. 100.

Cabela's Catalog, "Ladder Tree Stand", 1984, p. 100.

Cabela's Catalog, "Texas Deer Stand", 1984, p. 100.

Cabela's Catalog, "Tree Steps", 1984, p. 100.

Coleman Company, Inc., "Lantern Hanger", 1985, advertisement.

Sear's Catalog, recreational table, 1988, 1989, pp. 287, 895-897.

*Primary Examiner*—Peter A. Aschenbrenner

*Attorney, Agent, or Firm*—Luke Santangelo

[57] ABSTRACT

An anti-rotational outdoor shelf (1) where an unobstructed surfaces (3) is supported from below. Multi-dimensional stability is provided by legs (4) angled with respect to a central axis (C—C) to transform load forces into stabilizing forces. Undesirable tipping, rotation, and revolution about a support member are addressed. A gap between surfaces (3) and the natural support, such as a tree, together with smooth legs (4) allows vertical sliding to avoid the need for tight attachment. The design compacts when not temporarily installed through slidable connections.

12 Claims, 8 Drawing Sheets

ANTI-ROTATIONAL OUTDOOR SHELF

This is a continuation-in-part of application Ser. No. 07/420,366 filed Oct. 12, 1989 entitled "Outdoor Shelf" and now abandoned.

FIELD OF THE INVENTION

Generally, the present invention relates to the field of outdoor domestic items. Specifically, it relates to extremely stable recreation devices for convenience at events such as picnics, and backyard or camping excursions. More specifically, the invention relates to outdoor shelves having anti-rotational means.

BACKGROUND OF THE INVENTION

Certainly almost every person has at one time or another been to a picnic. Many have also camped in the woods. At such events hardly a soul has not been faced with the problem of where to put things requiring a level surface. As an example, the seemingly simple task of where to safely place a drink can easily become a problem not worth the inconvenience of solving when situated outdoors. While naturally occurring elevated surfaces exist, they are not always convenient. When such natural occurrences are not present, the person faced with the problem usually considers placing the item on the ground. This is often an unacceptable solution for several reasons. First, the ground may not be level. Second, the ground may not be flat. Third, in placing any item temporarily on the ground, there is always a risk of it being knocked over accidentally.

Prior to the present invention, other available solutions to this inconvenience also had drawbacks. One could, of course, create a level and flat surface by digging in the ground (usually with one's foot). Obviously this has the drawbacks of creating unsightly blemishes to the ground and perhaps even unnecessarily dirtying one's clothing. Another solution was not to stand where desired, but rather to position oneself in the vicinity of a surface on which one could balance the item. Again, the availability of such a surface may have posed a problem. Even when such a surface was available the inevitable "balancing" necessary made this solution often undesirable. Another solution was to simply disregard your initial desire to set the item down and instead hold it (frequently between one's knees). This not only accepted the inconvenience, but it required some degree of dexterity and often was unsuccessful as that item or other items frequently ended up in the user's lap. Basically, prior to the present invention, no device provided a solution which solved the problem in accordance with the magnitude of the inconvenience. Simply put, those faced with the problem usually accepted it as one of those inconveniences that inevitably accompanied enjoyment of the outdoors.

By stating that solutions were not available which were in accord with the perceived magnitude of the problem, it is not to say that no solutions were available. In fact, devices to solve the problem did exist. However, they were not practical from both a convenience and expense perspective. Certainly, picnic tables are well known. These provide exactly the desired effect. They do not, however, solve the problem in a manner which is both convenient and inexpensive. From a convenience perspective, the table must be placed in the desired area in a spot which is sufficiently level and flat. This placement often required more than one person as well. As to cost, the table itself was usually expensive enough that it did not solve the trivial problem of a temporary shelf for a minor item. Folding tables are also available. These devices, being relatively lightweight, again solved the problem, but not in accordance with the magnitude of the problem. They are usually much too expensive. They also rely, as does a picnic table, on the availability of a relatively level and flat ground surface. In order to overcome this latter limitation, three legged tables have been invented, however, they also fail to address the problem in accordance with its magnitude.

In other fields, devices have been proposed for different purposes; however, they are not adequate solutions to this particular problem. In the field of hunting devices, stands and seats have been proposed. The seat devices are available for attachment to trees and the like and, at first glance may seem to provide a solution to the problem. They do not, however, because they do not allow for stability along each of the three major axes. U.S. Pat. No. 4,600,081 to Wade is one such tree seat. The design of the Wade invention will tip forward unless the securing chain can be tightened adequately. However, the chain can only be adjusted in increments of a link size. For tree seat designs this is sufficient because as the user sits upon the Wade seat the leg supports dig into the tree. This gouging combined with the chain's inherent harshness can present problems for the tree itself, which is avoided by the design of the present invention. The fact that these designs function primarily as seats allows them to be inherently unstable as the user, having two feet planted firmly on the ground, can provide him or herself. U.S. Pat. Nos. 4,601,364 to York, and 4,928,793 to Westimayer demonstrate this accommodation. York utilizes a single angled support member to retain the seat portion in a horizontal plane, but the invention relies on the user to provide stability with his feet planted firmly on the ground.

Tree stands have also been proposed for hunting purposes. Since they are designed to be used without contact to the ground, stability has been more of a focus in their design. They have not provided an unobstructed surface as necessary to address the present problem. Rather, side supports and the like are commonplace in order to provide adequate stability. In addition, separate stabilizing harnesses are also included as the degree of stability of hunting tree stands is not usually even commensurate with that of the present invention—which is designed not for hunting purposes, but rather for temporarily holding minor items.

In the field of outdoor domestic items, some camping devices are also available. Of those items available, none address the present problem. Rather, the devices available are usually hooks and brackets and the like from which items can be hung. Certainly, when hanging an item, stability in its present sense is irrelevant. Thus, these devices have not provided a solution to the present problem. In fact, their very development highlights that the relevant field is a relatively slowly developing field which is characterized by incremental improvements on existing designs rather than radical departures from them. Within the field of outdoor domestic items, the focus on hangers and the like has actually directed &.hose skilled in the art away from the concern of providing an inherently stable shelf. Indeed, efforts in unrelated fields such as hunting devices, even suggest that those skilled in the art would be directed more towards external stabilization devices rather than a design which is inherently stable. Instead of focusing on new shelf designs, those skilled in the art have been directed to relying on ground support for stability as typical tables do.

The present invention recognizes and address each of these concerns and overcomes the limitations perceived by those skilled in the art by presenting a design which, among other aspects, allows for an inherently stable surface which is available and can be utilized with effort which is commensurate with the magnitude of the inconvenience.

SUMMARY OF THE INVENTION

It is an object of the present invention to provide a device which avoids forcing the user to move to a convenient position to meet his or her needs. Accordingly, an object is for the design to be able to be used in a variety of locations with no preparation of a natural support.

It is also an object of the present invention to provide an unobstructed surface which is inherently stable. In achieving this goal it is an object to support the surface only from below to maximize its usability. For the same reason, it is an object to provide a design that is extremely strong without requiring expensive designing or manufacturing and without increasing the procedures necessary to attach the design to a natural support.

An important object of the present invention is to provide a design which is portable so that it may be used for temporary applications. In achieving portability, an object is to allow for compaction of the device when not in use and to enhance its transportability through a lightweight design.

An object is to provide a design which can utilize existing natural supports as well as man made supports. Thus it is important that the design be able to be attached to both rounded as well as flat members. Particularly, the design has as an object providing the ability to be attached to a variety of trees and to fit a range of tree sizes as would typically be chosen by a user.

In general, it is an object to provide a design which allows a place to temporarily set items in a manner that is consistent with the magnitude of the desired convenience. Consequently, the design is both inexpensive and easily attached. An object is thus to allow for attachment in a manner that neither requires special tools nor requires unusual strength. The design can be effectively installed by even small children.

In keeping with the desire to provide a stable surface, it is an object of the present invention to achieve stability about three axes. In achieving multi-dimensional stability, an object of the design is to provide an affirmative stability rather than a level of stability as would be achieved through merely frictional forces. An object is to transform the vertical gravitational force from a load into forces which actually enhance stability when weight is placed on the surface. In keeping with this goal, it is an object for the device not to require any user monitoring or input for stability.

It is a further object of the present invention to provide for a design which is environmentally sound and does not damage or cause any impact to its natural support.

Further objects of the invention are disclosed throughout other areas of the specifications and claims.

DETAILED DESCRIPTION OF THE PREFERRED EMBODIMENTS

Figure 1:
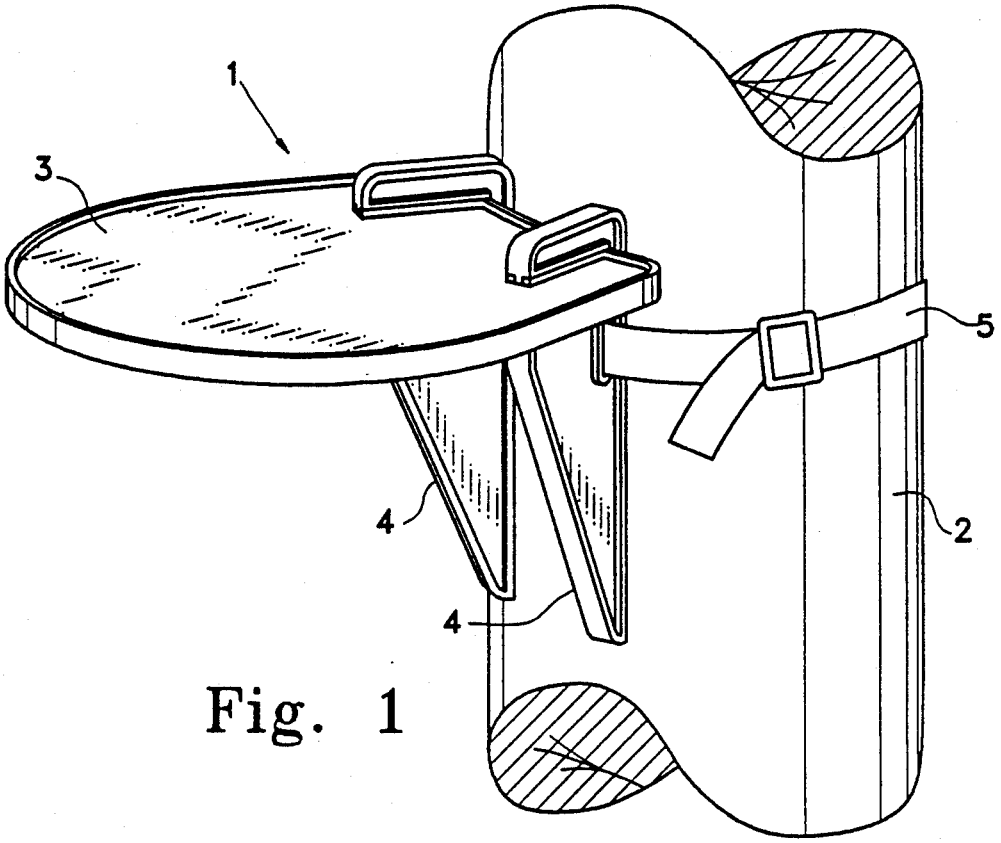
FIG. 1 is a perspective view of an embodiment of the invention as it would appear after attachment to a round member.

As can be readily understood from the claims and the drawings, the basic concepts of the present invention may be embodied in many different ways. FIG. 1 shows a perspective view of the entire shelf (1) attached to a natural support, in this case, rounded member (2) such as a tree.

General Features

As can be seen from the drawings, shelf (1) includes surface (3). Importantly, surface (3) is unobstructed above so that substantially all of the area is available for use. By "unobstructed," it is meant that no side supports or other such items significantly impinge upon the usable space of shelf (1). As with many shelf designs, this design has an angular means for supporting a surface in a substantially horizontal plane. By the term "angular means," it is simply meant that the shelf is supported at an angle (usually 90° ) with respect to its support. That is, the supporting elements are angled and may be perpendicular with respect to the surface they support. Their purpose is to retain the surface in a horizontal plane. While many different techniques to support the surface are possible, in this embodiment the angled supports are provided through use of legs (4) with a vertical edge (20). While legs (4) are shown to appear slightly above the top (shown) of unobstructed surface (3), this amount of intrusion is minimal thus allowing surface (3) to remain substantially unobstructed. As is discussed later, other techniques of attaching legs (4) to surface (3) provide for no obstruction at all. Shelf (1) is temporarily attached to rounded, or more generally, vertical member (2) through use of strap (5). As is discussed in more detail with respect with stability, the combination of strap (5) and legs (4) combine in such a manner so as to provide a design which holds unobstructed surface (3) largely level.

Figure 2:
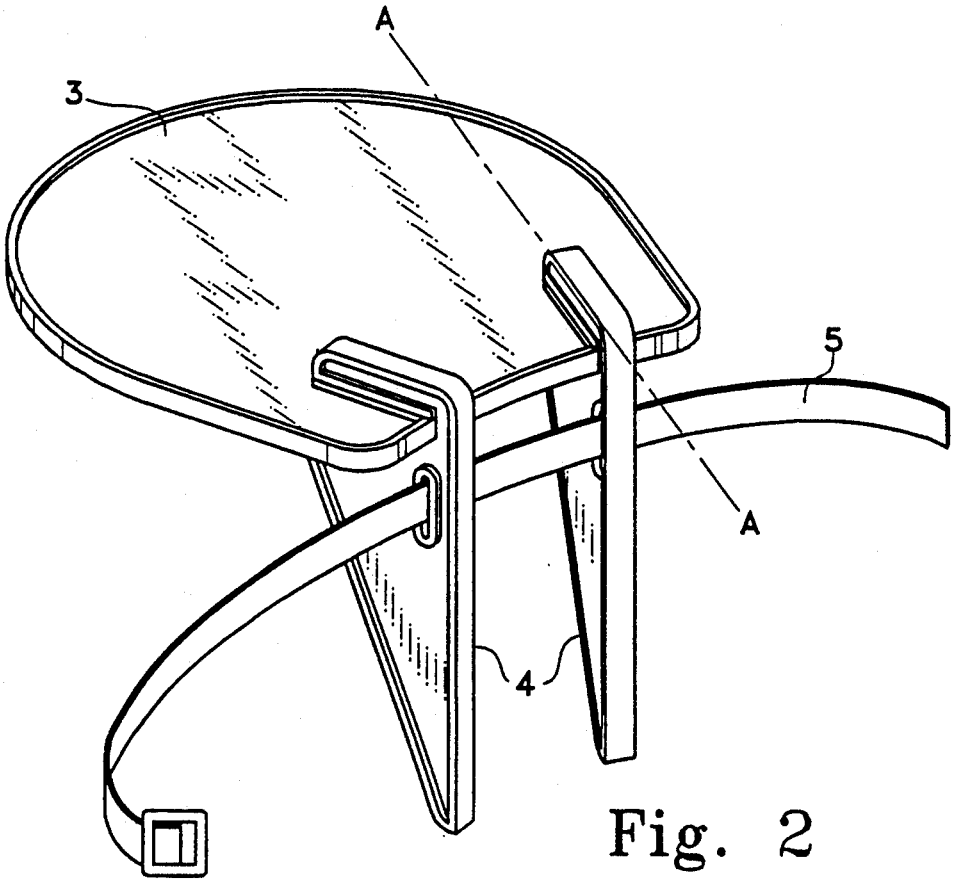
FIG. 2 is a perspective view of the same embodiment as it would appear from a back angle after assembly but prior to attachment to the round member.
Figure 3:
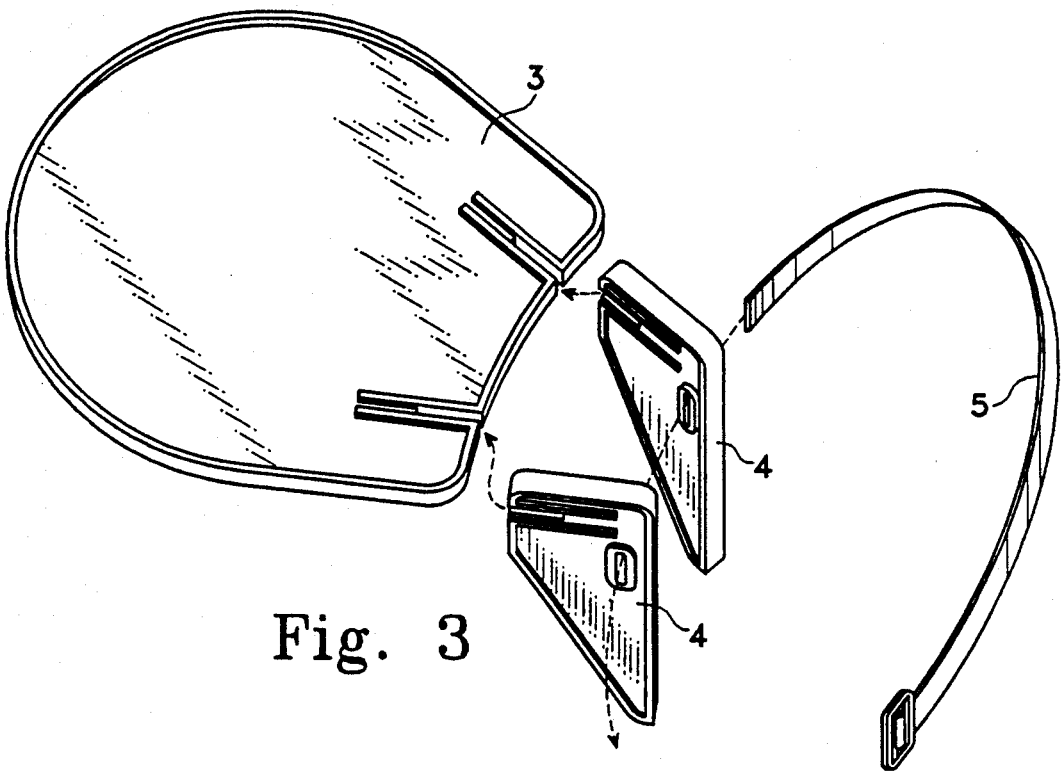
FIG. 3 is an exploded view of the same embodiment.
Figure 4:
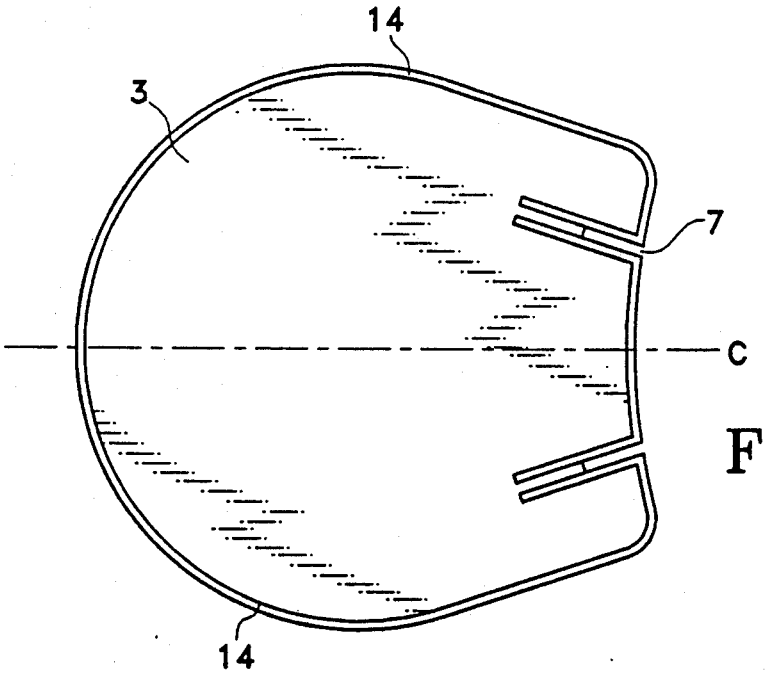
FIG. 4 is a top view of the unobstructed surface element of the embodiment.
Figure 5:
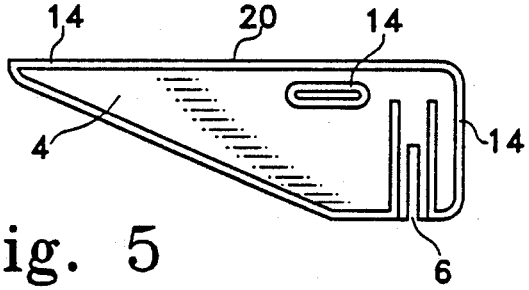
FIG. 5 is a side view of one leg of the embodiment.
Figure 6:
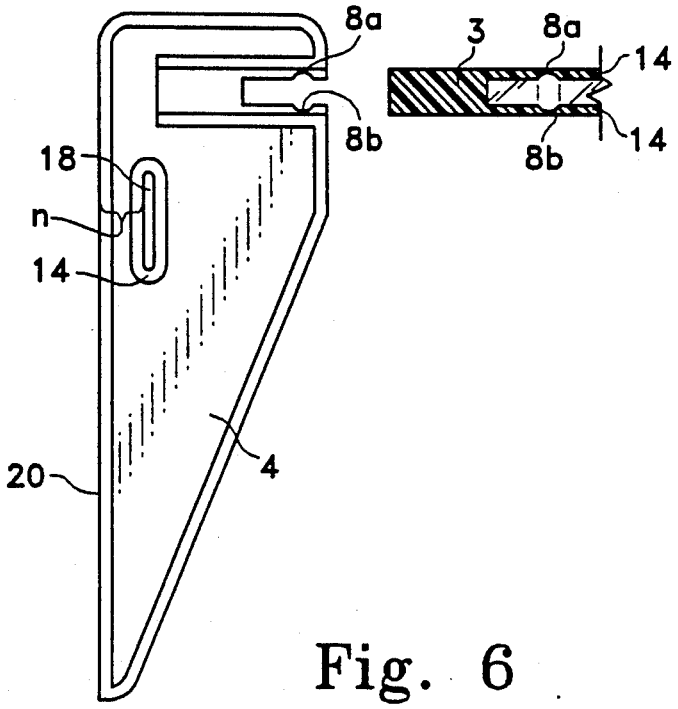
FIG. 6 is a cross sectional view through line A—A of the embodiment after assembly.

Referring now to FIG. 2, the back side of shelf (1) exposes legs (4) extending beyond surface (3). Strap (5) passes through legs (4). Legs (4) attach to surface (3) along line A—A shown. In order to accommodate user desires, the entire shelf (1) is designed to allow it to be compacted (in one case, by taking it apart) when transported or not in use. The present invention provides an integral means for compacting the shelf. This means that the compacting element is essentially part of shelf (1). Naturally, a variety of techniques can be utilized to allow for compaction of the device. Essentially all that is necessary is that legs (4) be allowed to be placed parallel to unobstructed surface (3) and possibly even stored in a bag or other such container. Referring to FIG. 3, an exploded view of this embodiment, it can be understood that the means for compacting chosen is a slidable attachment for legs (4). This slidable attachment allows legs (4) to interconnect easily with unobstructed surface (3). In FIGS. 4 and 5, this interconnection can be understood when it is realized that leg notch (6) interconnects with surface notch (7). FIG. 6, a cross-sectional view, shows this interconnection. As can be seen, leg notch (6) and surface notch (7) interconnect to form a fixed connection. This connection may include tabs or protrusions (8*a* and 8*b* ) for the purposes discussed later.

Figure 7:
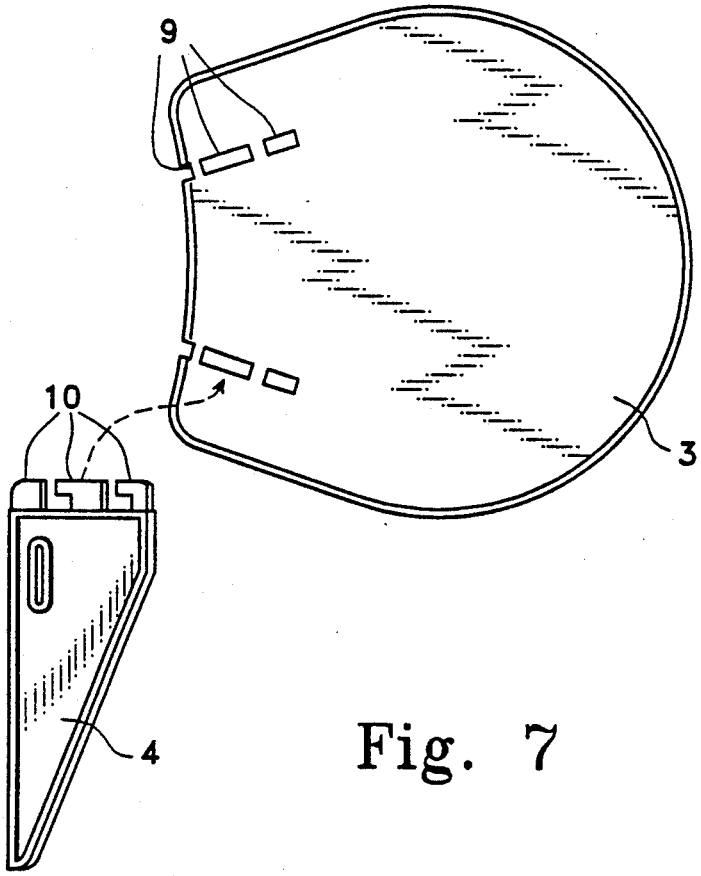
FIG. 7 is an exploded view of an alternative embodiment focusing on the means for slidably attaching and detaching the leg as seen from below.
Figure 8:
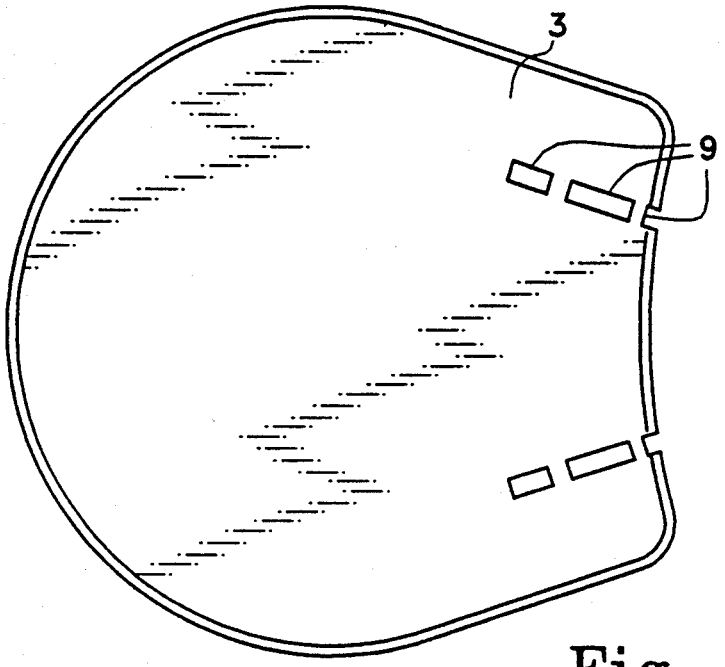
FIG. 8 is a top view of the unobstructed surface element of the embodiment shown in FIG. 7.
Figure 9A:
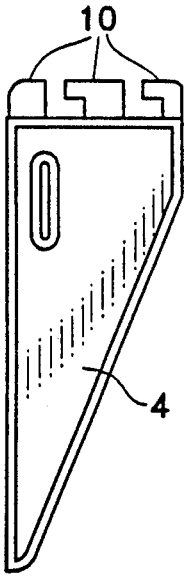
FIGS. 9*a* and 9*b* are a side view and an edge view of one of the legs depicted in the embodiment shown in FIG. 7.
Figure 9B:
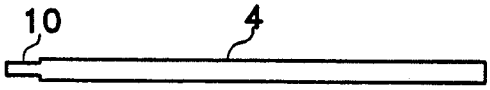
Figure 10:
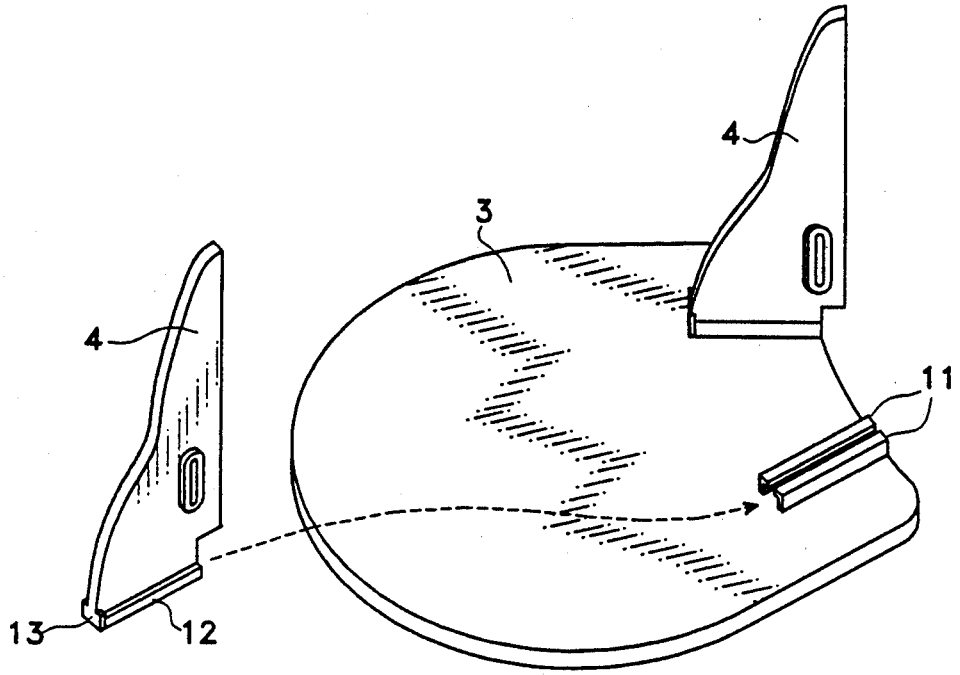
FIG. 10 is an exploded view of another alternative embodiment focusing on the means for slidably attaching and detaching the leg as seen from below.
Figure 11:
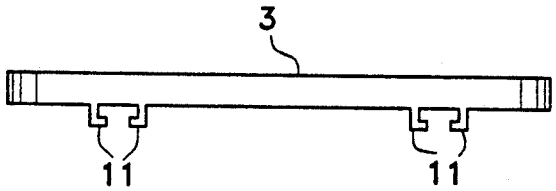
FIG. 11 is a back view of the unobstructed surface element depicted in the embodiment shown in FIG. 10.
Figure 12:
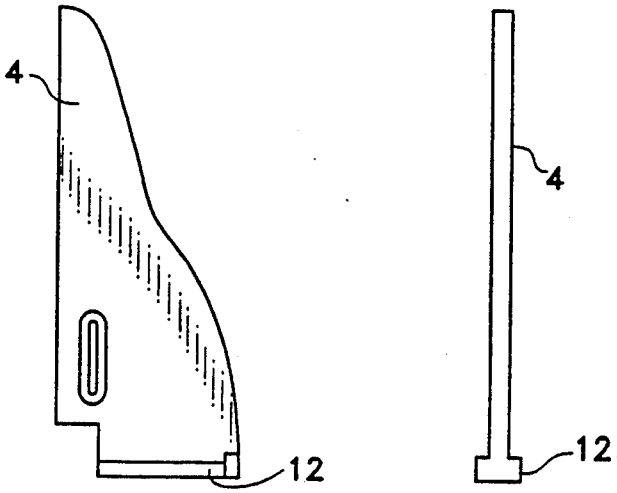
FIG. 12 is a side view of one of the legs depicted in the embodiment shown in FIG. 10
Figure 13:
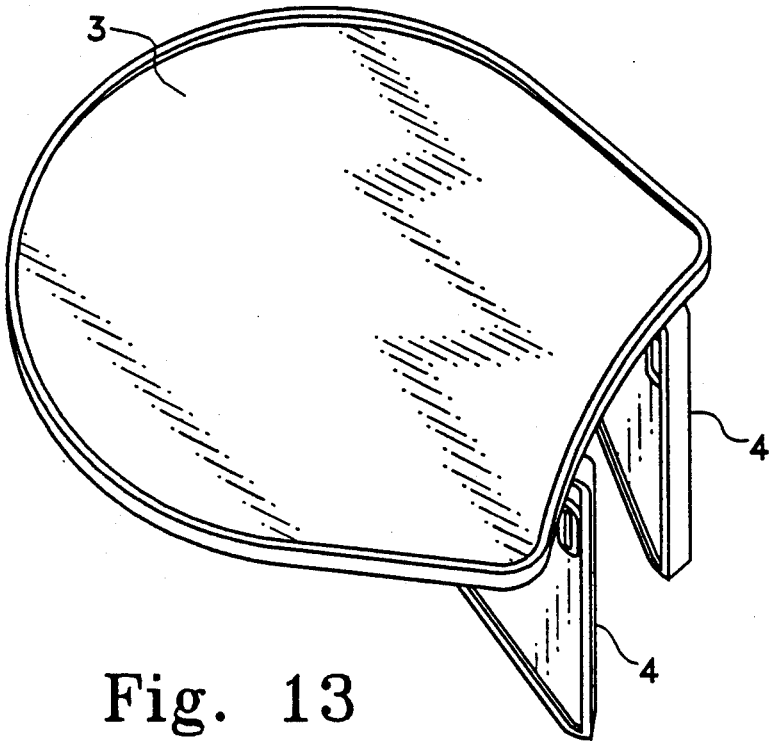
FIG. 13 is a perspective view of the embodiment shown in FIG. 10 after assembly.

Referring to FIGS. 7, 8 and 9, and FIGS. 10, 11 and 12, it can be seen that other types of connection between leg (4) and unobstructed surface (3) are also possible. In FIGS. 7, 8 and 9, it can be seen that a series of holes (9) and inserts (10) are possible. As can be readily understood from FIG. 7, inserts (10) can be placed in holes (9) and slid forward to affirmatively lock leg (4) in place against unobstructed surface (3). Again, only minimal interference with surface (3) exists so that surface (3) remains substantially unobstructed. Referring to FIGS. 10, 11 and 12, another alternative means for compacting the device is shown. This means consists of a series of guides (11) into which rail (12) at top of leg (4) slides. As can be seen from reference to FIG. 10, leg (4) may be slid in from the front of unobstructed surface (3) until it contacts stop (13). After assembly, this embodiment, shown assembled in FIG. 13, results in a completely unobstructed surface (3).

Figure 18:
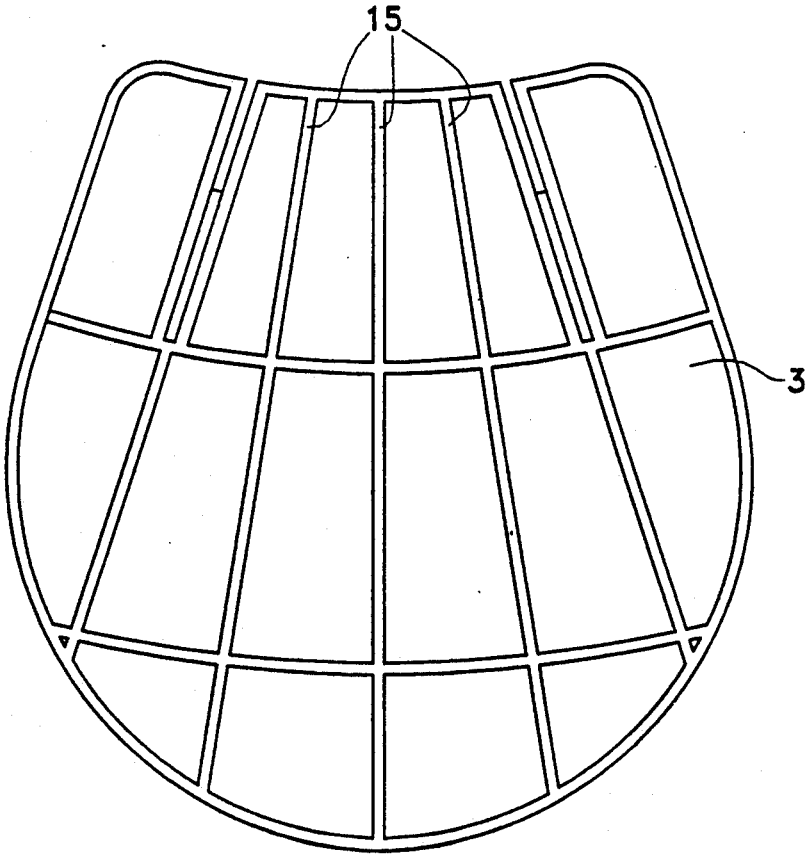
FIG. 18 is a view of the bottom of an unobstructed surface member having support ribs included.

As mentioned, strength is a desired goal. Referring to FIGS. 2 through 6, the inclusion of lips (14) is shown. These lips are extensions of the material forming the top of unobstructed surface (3) to allow for added thickness around the edges and thus enhance the structural capability of all items. Lips (14) exist not only on unobstructed surface (3) but also on legs (4) and around slot (18) and can be designed to also reinforce the strength of the connection between legs (4) and unobstructed surface (3) after assembly. Other techniques to augment the structural capabilities of shelf (1) are certainly possible. Included among these is the design in FIG. 18, including ribs (15). Some of the ribs (15) are arranged in an arc fashion for aesthetic appeal and maximum surface support and lateral rigidity. Remaining ribs (15) intersect arced ribs in roughly a perpendicular fashion, and provide increased surface rigidity. Naturally, other rib designs may be utilized to accomplish increased rigidity.

Figure 15:
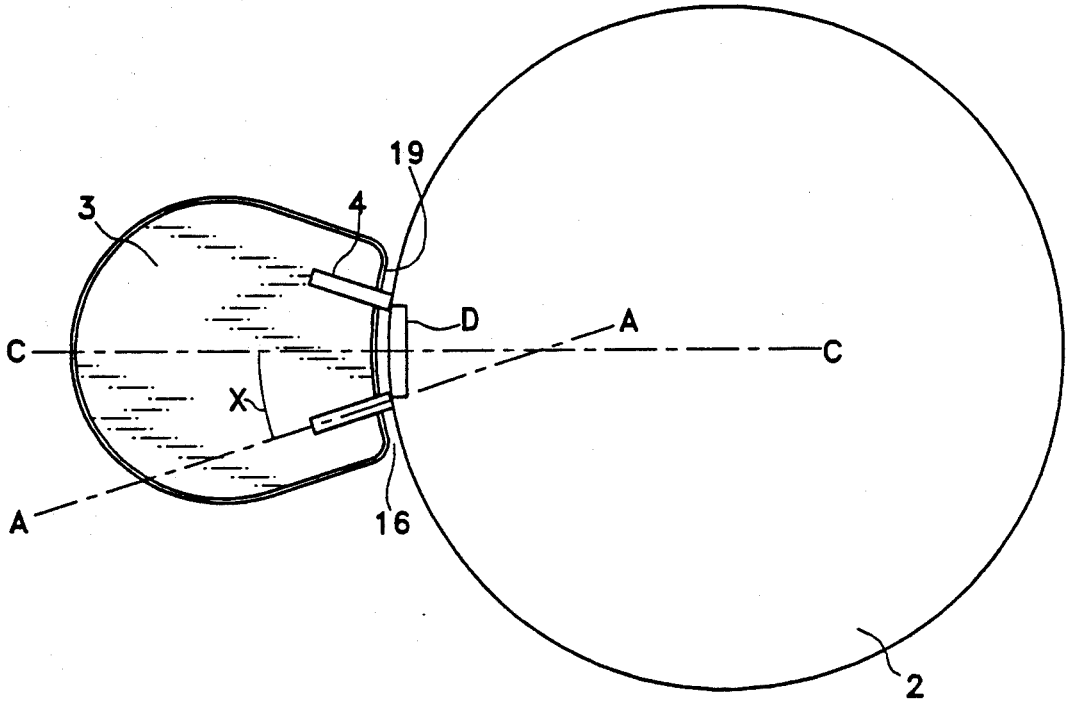
FIG. 15 is a top view of the embodiment shown in FIG. 2 after attachment to a round member.

As mentioned earlier, the device is designed to be able to be used on a variety of natural supports. All that is necessary is that strap (5) be able to attach and hold shelf (1) securely against the natural support. Of particular importance due to its common occurrence is the ability to attach shelf (1) to a rounded or vertical member (2) such as a tree. In FIG. 15, a top view of such an attachment is shown. As can be seen, legs (4) extend beyond the proximal edge (19) of unobstructed surface (3). Proximal edge (19) is the edge closest to vertical member (2) when shelf (1) is attached. This extension creates gap (16). Gap (16) serves to keep unobstructed surface (3) from contacting vertical member (2) for reasons discussed below. Strap (5) can then pass completely around vertical member (2) and through slot (18) in legs (4) to hold shelf (1) securely in place.

Figure 16:
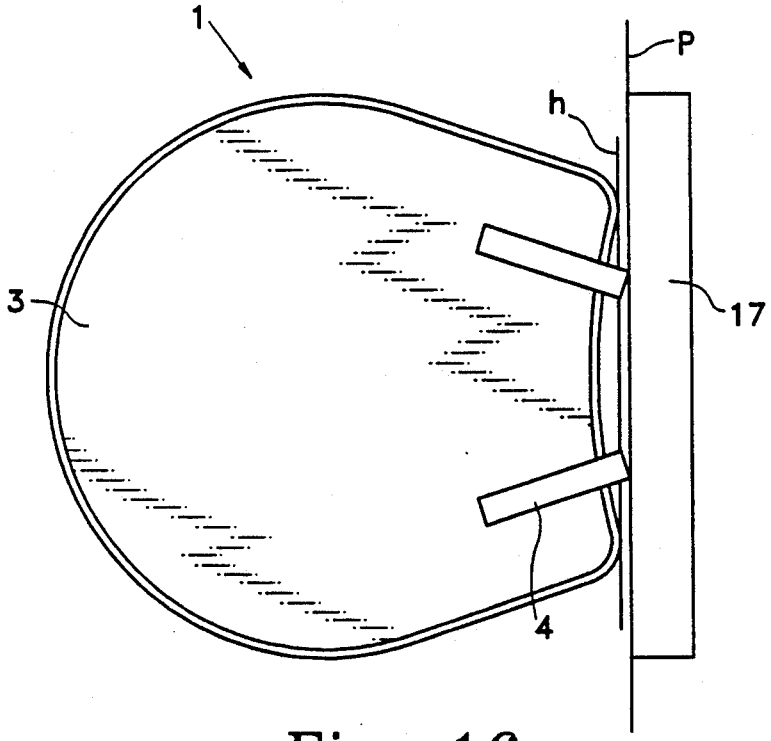
FIG. 16 is a top view of the embodiment shown in FIG. 2 after attachment to a flat member.

Referring to FIG. 16, it can be seen that shelf (1) can also be attached to a flat member (17) as well. For such applications, it is a feature to have chord line (h) spaced apart from flat plane (p) to avoid contact of unobstructed surface (3) with flat member (17). This is achieved through coordination of the extension of legs (4) which would typically create gap (16) and the amount of curve on the backside of unobstructed surface (3). If either the extension of legs (4) is not sufficient or the amount of curve along proximal edge (19) of unobstructed surface (3) is too great, cord line (h) will directly contact the face of flat member (17), shown as plane (p). Not only may this result in a surface that is no longer level, but it results in decreased stability as discussed. Through this design, shelf (1) can be attached to a variety of surface shapes, "rounded" being meant to merely indicate the ability to accommodate a broad variety of non-flat surfaces.

Another general feature of the device is the fact that it is designed for quick and easy attachment. Again, the element used to effect the attachment can be a variety of products. As shown, strap (5) is one type of attachment means which is commonly available. Through utilizing a non-elastic strap, the stability of unobstructed surface (3) is enhanced. Strap passes through legs (4) not only at or below surface (3) but in a manner which creates a span (n) (shown in FIG. 6) as the distance between vertical edge (20) of leg (4) and slot (18). Span (n) thus serves to effect a twist of leg (4) when attached for reasons discussed below. Strap (5) is then joined through sliding buckle or other such adjustable attachment means such as velcro and the like. In this manner a large variety of sizes of vertical member (2) can be accommodated.

Referring to FIG. 15, it can be seen that legs (4) are spaced a distance (d) apart. This distance affords not only the stability desired but is designed to allow accommodation of a variety of existing vertical members or trees. From experience, it has been discovered that while the range may vary from as small a distance as 2.5 inches to as large a distance as 16 inches or more, a distance of about 3.5 inches is the most practical as it not only accommodates the sizes of shelves typically desired, but it functions well on the types of vertical members to which such units would typically be attached. It also combines the consideration of aesthetics as well as functional characteristics.

Stability Features

There are three stability concerns addressed by the present invention. The first is forward tipping. This often occurs in prior art devices which utilize chains as a means for securing to a rounded member. As the chain loosens the surface tips forward potentially discarding anything placed upon it. The second concern is rotational or side-to-side stability. Designs having parallel support members are prone to this common undesirability. Since parallel supports typically adjoin a rounded member on one side providing no opposition to lateral movement. The third concern has to do with revolution about the rounded member. This instability is more common with smooth rounded members, such as posts or metal poles. In some prior art devices accidental contact may cause them to rotate about the rounded member. Sometimes this is in conjunction with one of the other types of instabilities. Many of the prior art devices are designed to address one, and sometimes two of these instability problems, while the present invention is designed to overcome each of these instabilities.

A very significant feature of the present invention is the way in which it provides a stable surface. Unlike many other designs, this design provides for multidimensional stability in that unobstructed surface (3) is not only angularly supported as in typical shelf units, but it is also designed to resist rotation about a central axis (C—C) and avoid revolution of the whole unit around a rounded member. In achieving such stability, the design does not merely provide for such stability through frictional forces as in most units, rather, it provides for an affirmative means for such stability. Although the technique of providing angular supports below a shelf unit is well-known, when such units are temporarily attached to rounded members, the ability against any rotation about a central axis (C—C) (commonly referred to as twisting) and the ability to avoid revolution about the rounded member (commonly referred to as turning) have posed unique problems. Rather than solve these problems through any type of design which obstructs the space above unobstructed surface (3), or provide for a separate stabilizing attachment, this design avoids these difficulties through integral stabilizing elements positioned below unobstructed surface (3).

Referring to the Figures it can be seen that all embodiments incorporate legs (4) as rigid vertical members. These legs (4) differ from other designs which hang in order to provide stability. Instead, by being rigid they resist movement in all direction—not just in one direction. By positioning legs (4) substantially below the upper part of surface (3), surface (3) remains unobstructed as discussed earlier. While this may seem obvious from the consideration of typical shelf supports, when considering temporary units, stability has not been easily achieved. Two primary approaches have been either to support the unit from above or rely on friction for stability. Each of these has drawbacks. Support from above obviously obstructs the use of the surface. Friction has a problem in that it requires very tight attachment to the vertical member. This would usually be done by strongly clamping down on strap (5) in other designs. This not only takes a fair amount of strength but it may damage vertical member (2). It will also inevitably loosen and thus reduce the stabilizing forces. In using the present design, an extremely tight connection is not necessary. Rather, the design is made to provide for stability even when the connection is unusually loose. This is achieved through a design which is inherently stable.

Figure 17:
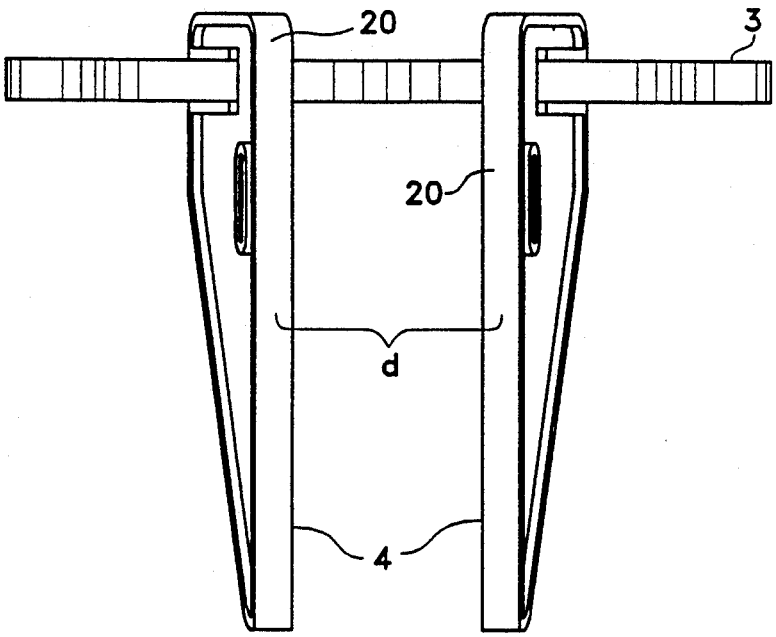
FIG. 17 is a back view of the embodiment shown in FIG. 2 after assembly.

Referring to FIG. 15, it can be seen that legs (4) extend beyond proximal edge (19). This results in gap (16) as mentioned earlier. In addition, referring to FIG. 5, it can be seen that vertical edge (20) is smooth so that legs (4) alone only angularly support surface (3). If strap (5) becomes loose, legs (4) are free to slide down vertical member (2). Unlike other designs in which such surface (3) would contact and become caught on vertical member (2), legs (4) merely move down the vertical member (2) when strap (5) becomes loose. If legs (4) were to function as in other designs, loosening of strap (5) would merely result in angling of entire shelf (1) not only causing a non-horizontal surface but also reducing stability. By providing gap (16), any tendency of proximal edge (19) to catch on vertical member (2) is avoided. In addition to smoothness of vertical edge (20), as can be seen from FIGS. 15, 16, and 17, legs (4) are relatively thin and are rounded at the bottom. Again, the desire is to avoid any unnecessary contact of horizontal surface with vertical member (2). By having shelf (1) only contact vertical member (2) along vertical edge (20) of legs (4), any reduction in the ability of shelf (1) to slide down vertical member (2) is minimized. Naturally, distance of vertical edge (20) of legs (4) needs to be significant enough to provide the necessary angular support.

Stability is also provided against rotation about a central axis (C—C). Referring to FIG. 15, central axis (C—C) can be seen to extend symmetrically through unobstructed surface (3). In creating a design which resists rotation about central axis (C—C), the present invention is unique in that other designs have not accommodated the desire to avoid rotation without obstructing the area above the surface and while allowing for temporary attachment to a rounded or vertical member (2) without relying on a friction means. As can be seen from FIG. 15, proximal edge (19) of surface (3) is curved. This curve is not designed to allow surface (3) to tightly fight against vertical member (2), but rather it is designed to create angle (x) for each leg (4) This angle (x) causes forces transmitted through legs (4) to have components both 5 perpendicular and parallel to central axis (C—C). Thus, the force created by a load on surface (3) (a vertical gravitational force) is transformed by the design in part into a force which resists rotation of unobstructed surface (3) about central axis (C—C). Naturally, the greater the angle (x), the more force is transformed. At its most minimum, an angle of 10° for each leg (4) seems to provide an acceptable amount of twisting stability. At the upper end, an angle of about 60° would provide a large degree of stability against such rotation. For most practical applications, however, intermediate values seem best. First, an angle of 45° results in an exact balance in the two components From practical experience an angle of 20° has been chosen as the proper balance between forces resisting rotation and angular support forces for most instances. This angle appears to provide the most optimum compromise not only from the perspective of the practical occurrence of rotative forces, but also from the desire to provide an aesthetically pleasing design. Naturally a curved element such as proximal edge (19) could be provided through separate elements or other designs.

The important aspect is only including the ability to transform forces from one direction into a force having as a component another direction.

In achieving stability the design also avoids revolution about vertical member (2). By having legs (4) extend beyond proximal edge (19) of unobstructed surface (3) to create gap (16), any amount of revolution other than small amounts is avoided in typical use. Again, by avoiding the sole reliance on friction, strap (5) need not be extremely tight. Rather, the exposed portion of legs (4) can fit within and interact with undulations in rounded or vertical member (2) to avoid revolution. To optimize this, vertical edges (20) are parallel to fit into bark and the like for practical interaction. This is particularly important when trees are used as a natural support. Most trees have an irregular bark in which legs (4) tend to position themselves on installation. Thus the person installing the device would maneuver shelf (1) into its most stable position naturally rather than as any conscious requirement.

In attempting to provide stability, many designs not only rely on friction but they also utilize attachment means which can damage the natural support. Through use of strap (5) and through the components of the design which allow shelf (1) to perform its function even without an extremely tight strap, damage to any surface of the natural support is avoided. By safeguarding against damage, the present invention achieves its intended purpose while at the same time being environmentally responsible.

Figure 14:
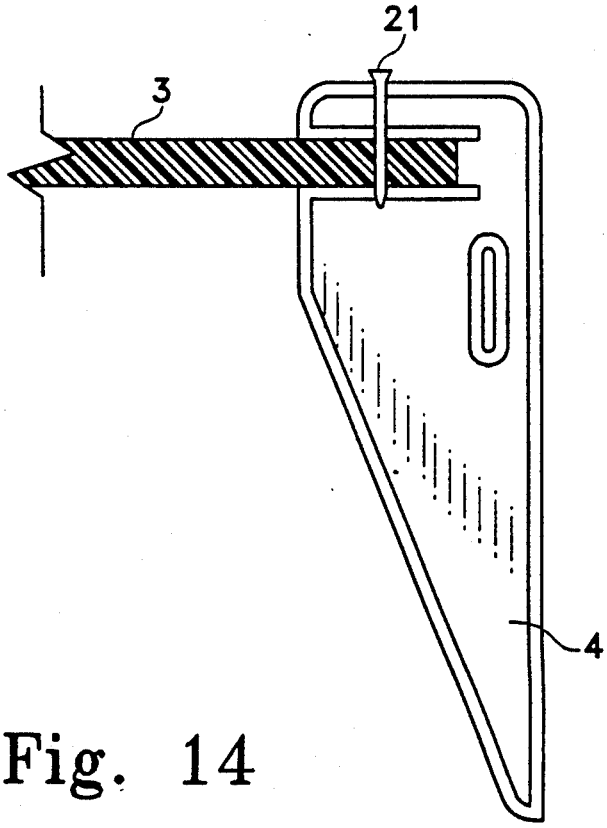
FIG. 14 is a cross sectional view similar to that of FIG. 6 showing a pin to retain the unobstructed surface.

The design also provides for a means to retain surface (3) against legs (4) when installed. While at first glance this aspect might appear unremarkable, in achieving a design which can be manufactured inexpensively, the use of a slidable assembly technique makes this aspect important. In the preferred embodiments, the angling of legs (4) with respect to central axis (C—C) of surface (3) acts as one means for retaining surface (3). Since legs (4) resist any revolution about vertical members (2), attempts to pull surface (3) off legs (4) in designs shown in FIG. 6 are met with resistance by the fact that the legs (4) are angled. In addition, as shown in FIG. 6, slot (18) in leg (4) is placed a distance (n) from vertical edge (20). This distance creates a torque or each leg (4) about vertical edge (20). This torque through friction tends to further enhance the resistance of the angular attachment to any attempts to separate surface (3) from legs (4) when installed. This feature would also be effective when shelf (1) is attached to a flat member (17) as shown in FIG. 16. Further enhancements are also possible. For instance, as shown in FIG. 6, tabs or protrusions (8*a* and 8*b*) and corresponding depressions could be included easily so that addition of a load would further enhance the means for retaining surface (3). That is, as a load is supplied to surface (3) lower tabs or protrusions (8*b*) take a more affirmative hold and resist detachment of surface (3) from legs (4). Naturally, a single set of tabs or protrusions may be provided without deviating from the scope and spirit of the present invention. As shown in FIG. 14, pin (21) could be inserted for a positive means. In the embodiment shown in FIGS. 10, 11 and 12, a stop (13), when coupled with the appropriate direction in which to slidably connect leg (4) to surface (3), can serve the same purpose.

Finally, proximal edge (19) of unobstructed surface (3) could be extended in some fashion to interact with strap (5). In this manner, strap (5) will hold unobstructed surface (3) from any tendency to move along central axis (C—C) away from vertical member (2).

The foregoing discussion and the claims which follow describe the preferred embodiments of the present invention. Particularly with respect to the claims, it should be understood that changes may be made to the invention without departing from its essence. In this regard it is intended that such changes will still fall within the scope of the present invention. It simply is not practical to describe and claim all possible revisions to the present invention which may be accomplished. While particular embodiments of the invention have been described, it will be obvious that changes and modifications may be made without departing from the broad aspects of the present invention. To the extent such changes utilize the essence of the present invention, each would naturally fall within the breadth of protection encompassed by this patent. The claims therefore cover all such changes and modifications.

I claim:

1. An anti-rotational outdoor shelf assembly comprising:

a a rounded member having an exterior;

b an upward facing surface having a center and a central axis which extends through said center of said surface in a direction away from said rounded member, and wherein said surface is unobstructed above;

c a plurality of vertical supports for maintaining said surface in a horizontal plane, wherein said vertical supports are angled with respect to said central axis of said upward facing surface whereby said angled relationship provides side-to-side stability of said surface, and wherein said supports are below said top, and further wherein said vertical supports have the ability to become parallel to said surface to provide compactability;

d a strap for temporarily attaching said shelf to said rounded member wherein said strap is detachably connected to said vertical supports; and e means for avoiding revolution of said unobstructed surface about said rounded member integral to said vertical supports, wherein said vertical supports comprise at least one rigid vertical edge for engaging the exterior of said rounded member to avoid revolution, and wherein said vertical edge safeguards against damage to said rounded member.

2. An anti-rotational outdoor shelf assembly as described in claim 1 wherein said means for avoiding revolution further comprises a means for allowing contact with said rounded member only at said vertical edge.

3. An anti-rotational outdoor shelf assembly as described in claim 2 wherein said vertical supports are slidably attachable and detachable from said unobstructed surface.

4. An anti-rotational outdoor shelf assembly as described in claim 1 wherein said vertical supports have a vertical edge, and wherein said vertical edge has a smooth surface.

5. An anti-rotational outdoor shelf assembly as described in claim 4 wherein said unobstructed surface has an edge proximal to rounded member and wherein said leg extends beyond the proximal edge of said unobstructed surface to create a gap.

6. An anti-rotational outdoor shelf assembly as described in claim 1 wherein said angle is from 10° to 60 degrees.

7. An anti-rotational outdoor shelf assembly as described in claim 1 wherein said angle is 20 degrees.

8. An anti-rotational outdoor shelf assembly as described in claim 1 wherein said angle is 45 degrees.

9. An anti-rotational outdoor shelf assembly as described in claim 5 wherein said vertical supports are spaced a predetermined distance apart and wherein said distance is from 2.5 to 16 inches.

10. An anti-rotational outdoor shelf assembly as described in claim 5 wherein said vertical supports are spaced a predetermined distance apart and wherein said distance is about 3.5 inches.

11. An anti-rotational outdoor shelf assembly as described in claim 3 and further comprising at least one protrusion on said unobstructed surface which fits into at least one depression on said vertical supports during attachment, and wherein the application of torque to said vertical supports causes said protrusions to be gripped tightly within said depressions to resist detachment from said vertical supports.

12. An anti-rotational outdoor shelf assembly as described in claim 11 wherein said strap passes through said vertical supports at a distance from said vertical edge of said angled vertical supports to create a torque to resist detachment of said unobstructed surface.

* * * * *